US006315151B1

(12) United States Patent
Hupp et al.

(10) Patent No.: US 6,315,151 B1
(45) **Date of Patent: *Nov. 13, 2001**

(54) COLLAPSIBLE CONTAINER AND METHOD OF MAKING

(75) Inventors: Matthew Todd Hupp, Sharonville; Catherine Jean Randall, Cincinnati, both of OH (US)

(73) Assignee: The Procter & Gamble Co., Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/481,225

(22) Filed: Jan. 11, 2000

(51) Int. Cl.[7] ..... B65D 6/18
(52) U.S. Cl. ..... 220/666; 220/6; 220/783
(58) Field of Search ..... 220/6, 666, 783; 264/554

(56) References Cited

U.S. PATENT DOCUMENTS

| | | | | |
|---|---|---|---|---|
| D. 354,436 | | 1/1995 | Krupa . | |
| D. 375,259 | | 11/1996 | Whitehead . | |
| 3,197,062 | | 7/1965 | Day et al. . | |
| 3,319,684 | | 5/1967 | Calhoun . | |
| 3,949,933 | | 4/1976 | Giambrone et al. . | |
| 4,555,043 | * | 11/1985 | Bernhardt | 220/783 |
| 4,678,095 | | 7/1987 | Barnett et al. . | |
| 4,694,986 | | 9/1987 | Chou . | |
| 4,819,824 | * | 4/1989 | Longbottom et al. | 220/266 |
| 4,930,644 | | 6/1990 | Robbins, III . | |
| 5,379,897 | * | 1/1995 | Muckenfuhs et al. . | |
| 5,524,789 | | 6/1996 | Jackman . | |
| 5,549,213 | * | 8/1996 | Robbins, III et al. | 220/8 |
| 5,575,398 | | 11/1996 | Robbins, III . | |
| 5,581,047 | * | 12/1996 | Lazaroff | 174/35 R |
| 5,900,293 | | 5/1999 | Zettle . | |
| 5,911,338 | * | 6/1999 | Miller | 220/666 |
| 5,996,882 | * | 12/1999 | Randall | 229/117.05 |
| 6,092,687 | * | 7/2000 | Hupp et al. | 220/666 |

* cited by examiner

*Primary Examiner*—Stephen Castellano
(74) *Attorney, Agent, or Firm*—Peter D. Meyer

(57) ABSTRACT

An erectable and collapsible container, said container being transformable from a collapsed configuration to an erected configuration and comprising a plurality of collapsible walls, wherein said sidewalls comprise a polymeric material have: (a) a Flexural Modulus of from about 100 MPa to about 1750 MPa; and (b) preferably a wall thickness of the collapsible walls of from about 1 mil to about 20 mils, except when said polymeric material is polyethylene homopolymer said Flexural Modulus is at least about 275 MPa or said wall thickness is at least about 10 mils.

29 Claims, 3 Drawing Sheets

COLLAPSIBLE CONTAINER AND METHOD OF MAKING

FIELD OF INVENTION

This invention is directed toward containers for storage of objects, and more particularly toward containers that are reversibly collapsible.

BACKGROUND OF THE INVENTION

Polymeric storage bags are well known in the art and are commonplace in the market. Consumers use these bags for storage of a multitude of materials and purposes. More recently, polymeric storage bags with mechanical closure systems have become commonplace as well. The closure systems are integrated into the bag and offer great convenience over traditional bags that must be closed with a separate closure device, such as a thin, twistable metal wire or other fitting designed to be placed around the orifice-end of the bag. Although these bags are of great utility, they have a variety of limitations and disadvantages. For example, the closure systems tend to leak, particularly at the sides of the bag. Also, bags typically offer little or no structural integrity to liquid materials and therefore are not ideal storage devices for such materials. It can be difficult to utilize bags as a dispensing device, such as a serving container for foods, since sidewalls have little structural integrity and therefore can be difficult to maintain in a fully open configuration.

Rigid containers are also well known in the art. They offer many advantages over bags due to their rigid shape, such as ability to store liquids and to remain in a fully open configuration. However they suffer from a different set of drawbacks. For example they can be cumbersome to store and tend to be more expensive to manufacture than bags. Inexpensive rigid containers can be made, however these still suffer from the same storage disadvantage and further, tend to have poor quality seals, such that liquid materials contained in the container can leak.

It is also known to combine the benefits of bags and rigid containers in a single device while avoiding the disadvantages of both. More particularly, collapsible containers have been disclosed that can be conveniently stored in a flat configuration when not in use, but can be expanded into a rigid or semi-rigid container prior to use. For example, U.S. Pat. No. 5,179,897, issued Jan. 10, 1995 to Muckenfuhs et al. (The Procter & Gamble Company), incorporated herein by reference, discloses such a resiliently deformable container which can be stored in a flattened position when not in use, but which can be expanded to a three dimensional shape suitable for containing materials whenever desired. U.S. Pat. No. 5,996,882, issued Dec. 7, 1999 to Randall (The Procter & Gamble Company) discloses a reversibly collapsible container wherein the sidewalls can be articulated about two spaced apart lines of weakness that facilitate easy folding of the sidewalls for collapsing and expanding of the container.

U.S. Pat. No. 4,694,986, issued Sep. 22, 1987 to Chou, discloses another form of a container having fold lines. U.S. Pat. No. 4,678,095, issued Jul. 7, 1987 to Barnett et al., discloses a polygonal collapsible container. U.S. Pat. No. 5,575,398, issued Nov. 19, 1996 to Robbins III, discloses a collapsible container having axially movable sidewalls. U.S. Pat. No. 5,524,789, issued Jun. 11, 1996 to Jackman, discloses a container that is collapsible upon rotation between the top and bottom of the container. U.S. Pat. No. 3,949,933, issued Apr. 13, 1976 to Giambrone et al., discloses a collapsible container having sidewall panels that separate from adjacent sidewall panels upon collapse. U.S. Pat. No. 4,930,644, issued Jun. 5, 1990 to Robbins, III, teaches a collapsible thin film plastic container which does not have hinge lines in the sidewall.

U.S. Pat. No. 3,319,684, issued May 16, 1967 to Calhoun, discloses a container having ends with diagonal fold lines longer than the straight line distance between opposite ends of the fold lines. U.S. Pat. No. 3,197,062, issued Jul. 27, 1965 to Day et al., discloses an accordion-type tissue dispensing carton having both sidewalls and end walls which are hinged inwardly.

Despite these patents, it remains desirable to further improve the art in the area of reversibly collapsible containers. For example, it is desirable to provide reversibly collapsible containers that can be folded and expanded without the occurrence of fold lines or crease lines in the vicinity of the axis upon which the walls of the container are folded. Fold or crease lines induced as a result of irreversible stresses occurring within folded walls and typically appear as white lines running coextensively with the fold. In addition to an unsightly appearance, fold or crease lines can lead to structural flaws in the wall, ultimately resulting in leakage into or out from the container.

It is also desirable to provide reversibly collapsible containers which contain an integrated closure system which provides sufficient structural integrity for leak-free performance, yet which retains light, flexible walls for easy folding to an essentially flat configuration for storage or disposal.

It is further desirable to provide reversibly collapsible containers that are made from a clear or translucent polymer, such that materials being stored in the container can be seen without opening the container or emptying its contents.

It is still further desirable to provide reversibly collapsible containers that are heat resistant, so that for example) contents being stored in the container can be heated (e.g., food items), and that materials being stored in the container upon exposure to heat (whether intentional or incidental) are not damaged or contaminated by the polymer utilized constructing the container. It is especially desirable to provide a reversibly collapsible container as above made from a food-grade plastic, and further, a material that is suitable for cooking or heating, such as but not limited to microwaving and submersion in hot water.

Yet another desirable parameter of a reversibly collapsible container is that it be resistant to cracking at low temperatures. Such "cold cracking resistance" is particularly desirable to be provided in a container with collapsible sidewalls which is also heat resistant (and preferably microwavable), so that a container containing a material (such as but not limited to food) can be stored in a freezer, and then heated, without ever suffering from either cold cracking or heat-related problems.

It is still yet further desirable to provide a reversibly collapsible container having any one or more of the above attributes which can be easily and inexpensively made, such as by thermoforming.

The objects of this invention include providing reversibly collapsible containers made from a polymeric material that can provide any or all of the above desired characteristics. These and other objects of the invention as hereinafter described may become apparent to one of ordinary skill in the art are intended to be encompassed by the present invention in accordance with the claims which follow.

SUMMARY OF THE INVENTION

The present invention provides a reversibly collapsible container that can be provided in an essentially flat configuration, and can be provided in an expanded configuration suitable for containing a material therein. Preferably the container can be reversibly re-collapsed from an expanded configuration to the collapsed configuration. More preferably the container can be converted from the collapsed to the expanded configurations, and vice-versa, an indefinite number of times.

In general, the container comprises a plurality of walls, preferably including one or more sidewalls and an interconnecting floor pan. Preferably the container comprises a plurality of the sidewalls. Most preferably all of the sidewalls are collapsible. The number of sidewalls will preferably be four (4), however fewer and greater numbers of sidewalls are not meant to be necessarily excluded. For example the container could be cylindrical, with one continuous wall, or have three (3), five (5), or more walls.

The container can also comprise a seal bead connected to the sidewalls, and can further comprise a lid. The seal bead is preferably formed integrally with the sidewalls. The lid is also preferably formed integrally with the sidewalls. However both the lid and/or the seal bead, particularly the lid, can be formed as separate parts and then affixed to the container. The seal bead of the sidewalls is designed to mate with a corresponding seal bead in the lid.

The polymeric material useful for making the containers of the present invention is sufficiently flexible to permit the side walls of the container to be flexible and to avoid the formation of fold lines or creases, yet it is still sufficiently strong in preferred embodiments such that the seal bead of the container can be rigid enough to provide a tight, reliable seal. Preferably the seal formed with the lid is leak resistant. These contrasting requirements can be achieved by selecting particular polymeric materials used for constructing the container while controlling the thicknesses of the seal bead and the collapsible wall thickness.

The reversibly collapsible container of the present invention is made from a polymeric material having: (a) a Flexural Modulus of from about 100 MPa to about 1750 MPa; and (b) preferably a wall thickness of the collapsible walls of from about 1 mil to about 20 mils, except when said polymeric material is polyethylene homopolymer said Flexural Modulus is at least about 275 MPa or said wall thickness is at least about 10 mils. The wall thickness of the seal bead of the sidewalls is preferably at least about 1.5 times the thickness of the collapsible walls.

DETAILED DESCRIPTION OF THE INVENTION

Figure 1:
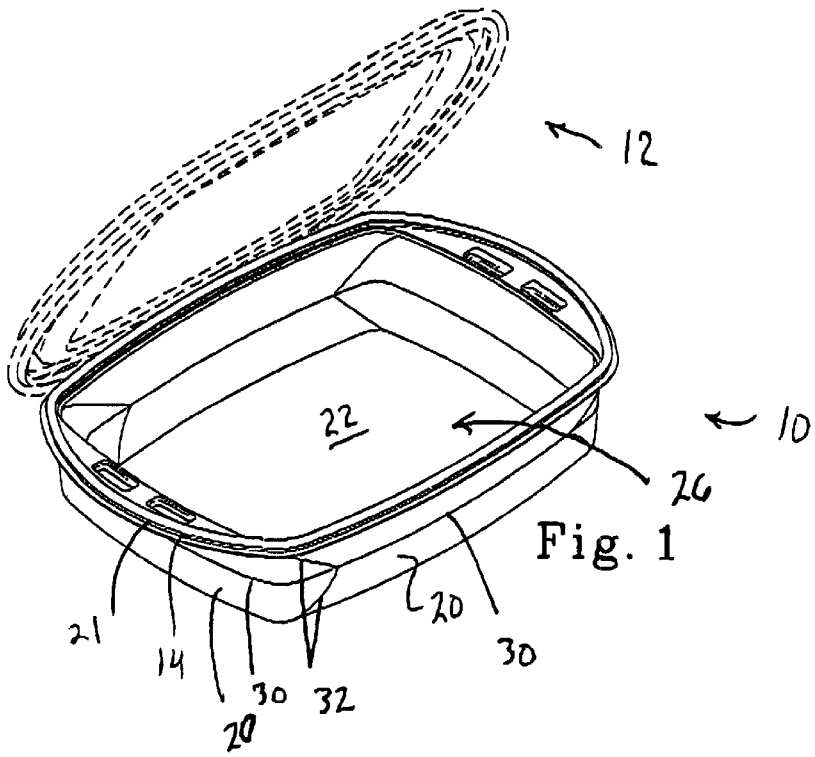
FIG. 1 is a perspective view of a container according to the present invention illustrating an optional lid, the container being in an erect condition.

The polymeric materials for use in the containers of the present invention are characterized by a Flexural Modulus of from about 100 MPa to about 1750 MPa, preferably from about 175 MPa to about 1350 MPa, more preferably from about 250 MPa to about 700 MPa, most preferably from about 275 MPa to about 550 MPa. For polymeric materials consisting essentially of polyethylene polymers, such as polyethylene homopolymers, and equivalents, the Flexural Modulus should preferably be at least about 275 MPa. As used herein, "Flexural Modulus" means the flexural modulus as determined according to ASTM Test Method D-790. The thickness of the collapsible sidewall in the containers of the present invention will generally be within the range of from about 1 mil to about 20 mils (about 0.025 mm to about 0.5 mm), preferably from about 2 mils to about 15 mils (about 0.05 mm to about 0.375 mm), even more preferably from about 2 to about 10 mils (about 0.05 mm to about 0.25 mm), most preferably from about 3 to about 6 mils (about 0.075 mm to about 0.15 mm). When low density polyethylene is used as the polymeric material, especially as the primary polymer, collapsible wall thickness is preferably from about 10 mils to about 20 mils (about 0.25 mm to about 0.50 mm). Wall thicknesses outside these ranges may be used and are intended to be encompassed within the present invention as long as the container sidewalls fulfill the purposes hereof—and in particular remain collapsible and have sufficient strength to form an erectable container suitable for containing the intended materials or contents of the container. The collapsible thicknesses suitable for use will vary according to the type of polymeric material that is used, including the polymer itself and the additives as will be discussed in more detail below. In general, it has been found that as wall thickness is reduced below 1 mil, the wall becomes too weak or becomes susceptible to having holes extending throughout the thickness of the wall. As wall thickness becomes larger, beyond about 20 mils or 0.5 mm, it becomes more difficult to fold and less compact when folded. Also, it becomes more the thickness needed to make a sufficiently strong seal bead may become impracticable for many applications. In general, higher Flexural Modulus materials will be optimally used at lower wall thicknesses that lower Flexural Modulus materials. By "collapsible sidewall" what is meant herein is that the sidewall can be folded by the user at least once to form a 180 degree fold, preferably without forming permanent crease or fold lines in the polymer. To assist in folding or to aid in selecting the location of the fold, the sidewalls may have one or more lines of weakness. These lines of weakness may be observable, however such intentionally introduced structures should not be confused with stress-related fold or crease lines that only become observable upon folding the sidewalls.

The seal bead, in general, should preferably have a thickness of at least about 1.5 times the thickness of the collapsible walls in embodiments where the seal bead and collapsible walls are made from the same polymeric material. Generally the seal bead thickness should be from about 1.5 times to about 8 times the collapsible wall thickness, preferably from about 2 times to about 6 times, more preferably from about 2 times to about 4 times.

The polymeric materials selected for use in the present invention can include any polymers that fulfill the purposes of the invention or which, with the addition of additives can be modified to fulfill the purposes of the invention. Polymers suitable for use herein include polyolefins, such as polypropylenes polyethylenes, and polyvinyl chlorides. The polymers preferably those selected from the group consisting of polyethylenes, polypropylenes, and mixtures thereof. Included within the above categories of polymers are copolymers containing ethylene monomer units and propylene monomer units, polymers containing substituted ethylene and/or propylene monomer units, and copolymers further containing other monomer units that are derived from monomers that are polymerizable with ethylene and/or propylene monomers. Also included are branched chain and linear polymers.

Preferably the polymeric material hereof comprises a primary polymer, combined with a secondary polymer that is compatible in admixture with the primary polymer but forms a discontinuous phase within the continuous phase of the primary polymer. In general, the polymeric materials hereof can comprise from about 51% to about 99% of the primary polymer and from about 1% to about 49% of the secondary polymer. In embodiments wherein the primary polymer is a relatively rigid material in comparison to the secondary polymer, the secondary polymer acts as an impact modifier to increase Flexural Modulus and cold crack resistance. Preferred impact modifiers are copolymers of ethylene and propylene, for example.

When polyethylene homopolymers are used, they are preferably either admixed with other, more rigid polymers (such as without limitation polypropylene), preferably (but not necessarily) as the secondary polymer, or have a Flexural Modulus of at least 275 MPa. Polyethylene homopolymers, and equivalents, with Flexural Modulus below this amount will generally have densities of 0.93 g/c or less, and commonly referred to in the art as low density polyethylene (LDPE). Therefore, when polyethylene homopolymers are used it is preferred that they either be medium or high density polyethylenes, or be used as the secondary polymer in the polymeric material. Preferred polymeric materials are polypropylene homopolymers and copolymers (such as copolymers with polyethylene or other polyolefin), especially admixtures of homopolymers of polypropylene as the primary polymer and either polyethylene or copolymers of polypropylene and polyethylene as the secondary polymer, especially mixtures of polypropylene homopolymer and polyethylene/polypropylene copolymers. Polyethylene/polypropylene copolymers can be incorporated into polypropylene homopolymers, for example, by subjecting the polypropylene, prior to extrusion, to a second reaction between unreacted propylene monomer and ethylene, to form a dispersed discontinuous phase of polyethylene/polyproplylene particles within a continuous polypropylene matrix.

Especially preferred for use in the present invention is syndiotactic polypropylene. Syndiotactic polymers are disclosed, for example, in U.S. Pat. No. 3,258,455, Natta et al. (incorporated by reference herein) and are preferably manufactured using metallocene or homogeneous catalysts, such as disclosed in U.S. Pat. No. 4,794,096, W. Kaminsky (Fina Technology, Inc.) (incorporated by reference herein).

The preferred polymeric materials hereof will be stable and retain structural integrity at temperatures of at least about 80 C, preferably at least about 100 C, most preferably at least about 120 C. The polymers hereof will therefore preferably have melt point (Tm) of at least about 110 C, preferably at least about 120 C, most preferably at least about 130 C. Tm is determined by Differential Scanning Calorimetry (DSC).

Preferred polymeric materials hereof will also be resistant to cracking at cold temperatures. Accordingly, it has been found that desirable cold cracking resistance can be obtained for flexible packages hereof made from polymeric materials hereof having an Izod Impact notched at 23 C (as determined according to ASTM Method D256), hereinafter "Izod Impact Value", of at least about 30 J/m, preferably at least about 50 J/m, more preferably at least about 100 J/m, most preferably at least about 500 J/m.

Also, preferably, the polymeric materials for use herein are either clear or translucent, such that the user is able to visually observe the contents of the container through the walls of the container with the naked eye. Clarity can be enhanced by the use of clarifying agents during manufacture of the polymeric material, according to techniques well-known in the art. Clarifying agents typically are used at levels of from about 250 to about 5000 parts per million (ppm) of the polymeric material, preferably from about 500 to about 3500 ppm. Clarifying agents include, without limitation, sulfur, selenium, antimony, proteins and carbohydrates, silicates, graphite, inorganic molecules and organic molecules. Examples of preferred clarifying agents, include dibenzylidene sorbital derivatives such as those available from Milliken and Company (Spartanburg, S.C., USA) as Millad Concentrate 3988.

Suitable polymers for use herein can be obtained, for example, as follows: Huntsman Corporation (Houston Tex., USA), PP23T1A, polypropylene homopolymer having a Flexural Modulus of 150,000 psi (1035 MPa), Tm 160–162 C, Izod Impact Value of 75 J/m; Fina Oil and Chemical Company (Dallas, Tex., USA), EOD 96-28, syndiotactic copolymer of polypropylene and polyethylene, having a Flexural Modulus of 50,000 psi (340 MPa), Tm 130 C, Izod Impact Value of about 640 J/m; and Fina Oil and Chemical Company (Dallas, Tex., USA), 6289MZ, copolymer of polypropylene and polyethylene, having a Flexural Modulus of 140,000 psi (969 MPa), Tm 147 C, Izod Impact Value of 70 J/m. In addition to the polymer compounds themselves, the polymeric materials for use herein may contain one or more additives such as, without limitation, antistatic agents, antioxidants, colorants, flame retardants, lubricants, mold release agents, plasticizers, and ultra-violet light stabilizers, and combinations thereof. Such additives and their use, including the levels thereof, are well known in the polymer art. Typically, they are added at a level of from about 100 to about 5000 ppm, by weight of the polymer.

The present invention further relates to a method for making containers as described above by thermoforming. In particular, the present invention relates to a method of making an erectable and collapsible container comprising the steps of: (a) providing a bead of polymeric material having a Flexural Modulus of from about 100 MPa to about 1750 MPa, except when said polymeric material is polyethylene homopolymer said Flexural Modulus is at least about 275 MPa or said wall thickness is at least about 10 mils; (b) thermoforming said bead to form a container having a plurality of collapsible walls, and said collapsible walls preferably having a thickness of from about 1 mil to about 20 mils. Preferably the collapsible walls are collapsible sidewalls, and said container further comprises an interconnected floor pan, said sidewalls projecting from said floor pan have a bottom end connected to said floor pan and a top end distal from said bottom end, said container further comprising a seal bead at said top end of at least three of said sidewalls. In addition, the various optional and preferred aspects of the invention as described above are also contemplated for application in conjunction with the thermoforming method hereof. The thermoforming steps can be accomplished using techniques and at temperatures and conditions well-known in the art. The relative thicknesses of the seal bead and the sidewalls will be controlled by the skilled thermoforming artisan by choosing process conditions, mold design, depth of the container (height of the sidewalls), size and thickness of the container floor, and thickness of the starting bead of polymeric material. Preferably the floor thickness is within the same ranges preferred for the seal bead.

Referring now to the drawings, FIG. 1 depicts a preferred embodiment of a container 10 according to the present invention. In the embodiment depicted in FIG. 1, the container 10 includes a container 10 body preferably unitarily formed from a sheet of polymeric material. An optional lid 12 may be included and unitarily formed with the container 10. The container 10 may also include a closure for sealing the lid 12 and container 10 to form a seal 14, such as by mating of a seal bead 21 of sidewalls 20 with a seal bead 13.

Figure 2:
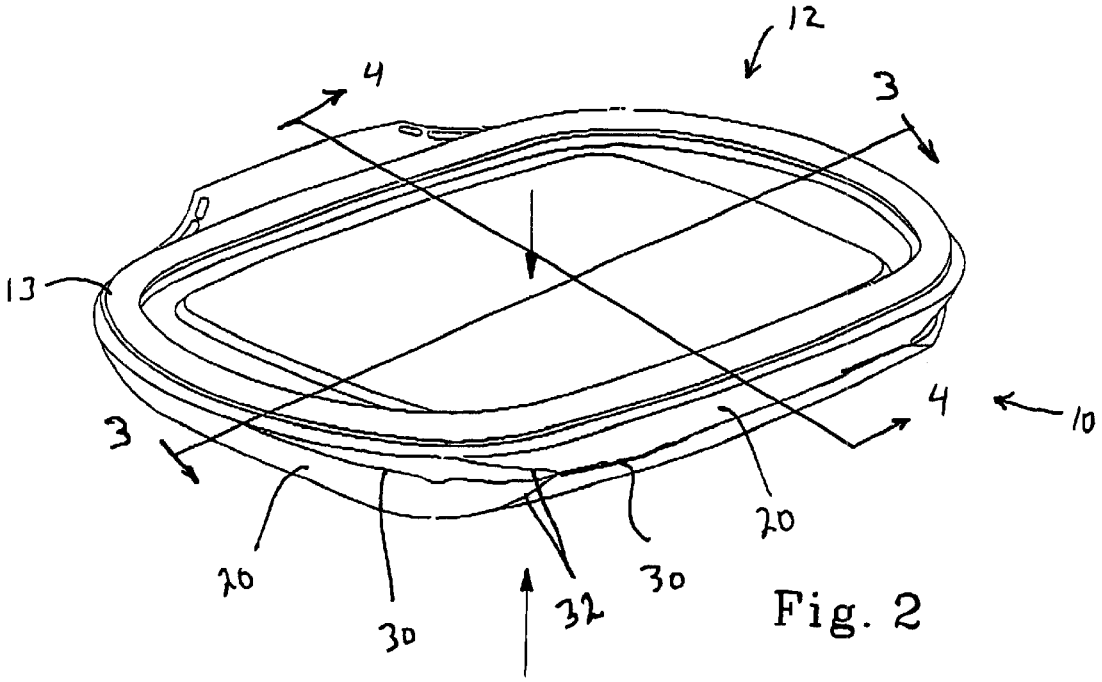
FIG. 2 is a perspective view of the container of FIG. 1 being shown in a collapsed condition.

Referring to FIGS. 1 and 2, the container 10 according to the present invention is reversibly transformable between two conditions, a collapsed condition and an erect condition. The container 10 has a first volume associated with its collapsed condition. The container 10 further has a second volume associated with its erect condition. The second volume is greater than the first. The container 10 may be collapsed in stages, as the contents are depleted. This provides the benefits of requiring less storage space and removing oxygen from the container 10 if perishable contents are stored therein. Preferably, the second volume is at least 50% less than the first volume. Volume may be ascertained by filling the container 10 with water in both the collapsed and erected conditions.

The container 10 according to the present invention may be relatively small, such that when the container 10 is in an erect condition, the container 10 may be stored in one's pocket or purse. Such a container 10 may be usefull for storing pills, capsules, etc. Alternatively, the container 10 may be relatively large such that the container 10 is sized to fit a flat bed semi-truck. Such a container 10 may be useful for carrying construction materials, etc. One contemplated use for the container 10 is to store perishable items such as food.

The container 10 comprises a floor pan 22 and sidewalls 20 projecting outwardly from the floor pan 22. Preferably, in use, the sidewalls 20 project upwardly and terminate at a distal end 46 forming the mouth 26 or opening of the container 10. The illustrated embodiment has four sidewalls 20. However, it is to be recognized the invention is not so limited. The sidewalls 20 have a length, taken parallel to the floor pan 22, which is greater than the height, taken in the collapse direction.

The lid 12 may be generally flat, as illustrated, or may have a convex inward or convex outward orientation, as desired. For certain embodiments, it is preferred that the lid 12 be substantially flat so that the container 10 is stackable.

The floor pan 22 defines and lies in a first plane. For the embodiment illustrated, the floor pan 22 is defined by the vertices at the four corners of the upstanding sidewalls 20. The floor pan 22 may be domed convex inwardly to increase strength, as is known in the art. Particularly, domed floor pans 22 provide increased strength for loading by the contents of the container 10 in a direction normal to the floor pan 22. Alternatively, the floor pan 22 may be disposed convex outwardly, although this may be decrease stability when the container 10 rests on a horizontal surface. It is to be recognized and appreciated that the floor pan 22 may be domed as is known in the art yet still define a plane.

The sidewalls 20 are illustrated to be generally perpendicular to and projecting outwardly from the floor pan 22. It is to be recognized that sidewalls 20 which project outwardly in a non-perpendicular orientation, e.g., such as a divergent orientation to provide a greater cross section at the top of the container 10 than at the floor pan 22, are known and may be utilized in accordance with the present invention.

At least one of the upstanding sidewalls 20 has a hinge line 30 therein. It is to be recognized that, as illustrated, each of the upstanding sidewalls 20 may be provided with a hinge line 30, as illustrated, in a more preferred embodiment, as illustrated. The hinge line 30 is generally orthogonal to the direction of collapse and erection of the container 10, and thus may be generally parallel to the plane of the floor pan 22 in a preferred embodiment. Alternatively, if the hinge lines 30 are not parallel to the plane of the floor pan 22, the sidewall 20 will collapse into a somewhat triangular shape increasing the height of the container 10 when it is in the collapsed condition. It may be desired to collapse the container 10 into a triangular configuration if one expects to dispense farinaceous or pasty products from the opposite sidewall 20 of the container 10. For such an embodiment, the aperture 26 of the container 10 may be disposed in that sidewall 20. More particularly, the container 10 is erectable and collapsible in a direction having a vector component perpendicular to, and preferably identically perpendicular to the plane of the floor pan 22.

Transformation of the container 10 from an erected condition to a collapsed condition is in response to compressively applied forces having a vector component parallel to, and preferably identically parallel to the collapse direction. Likewise, erection of the container 10 from a collapsed condition may occur in response to extension forces applied in a direction having a vector component parallel to, and preferably identically parallel to the collapse direction but having an opposite sense.

Figure 3:
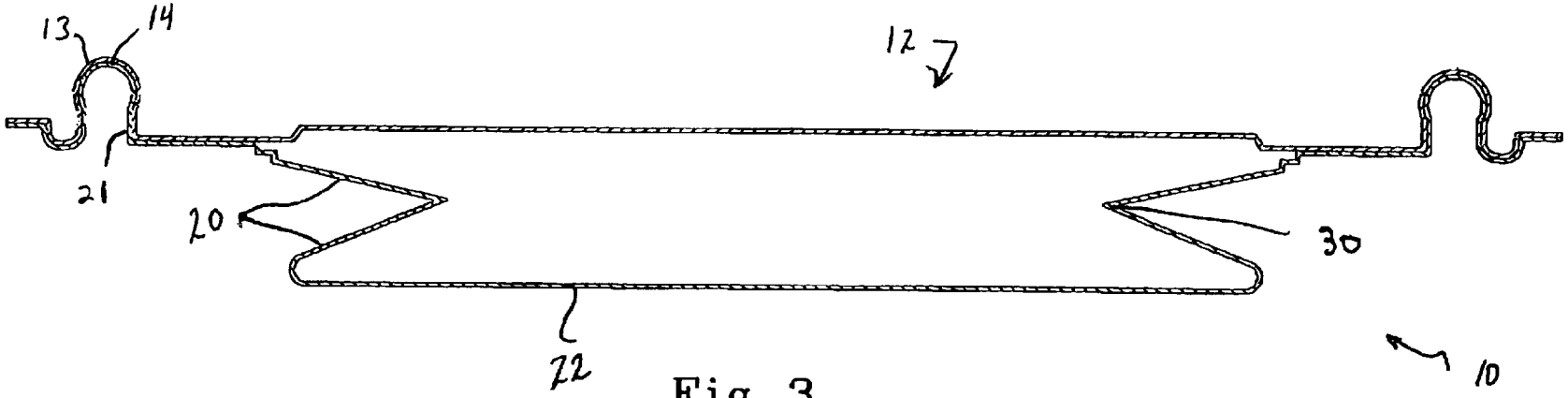
FIG. 3 is a vertical sectional view taken along lines 3—3 of FIG. 2.
Figure 4:
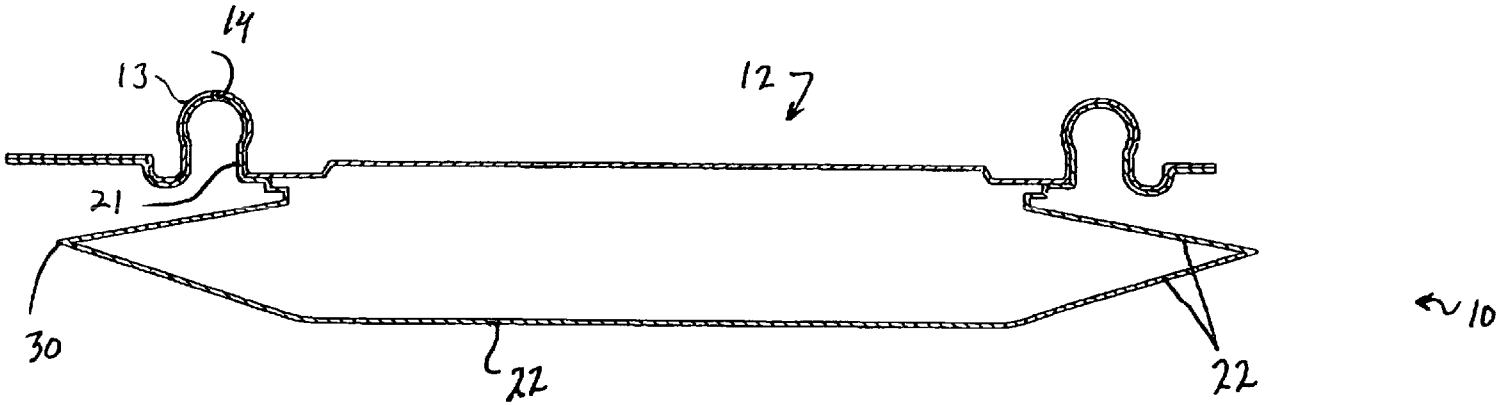
FIG. 4 is a vertical sectional view taken along line 4—4 of FIG. 2.

As illustrated in FIGS. 3–4, the hinge line 30 in the at least one sidewall 20, and preferably all sidewalls 20, or any combination therebetween, is preferably formed by providing a line of weakness in the sidewall 20 of the container 10. The line of weakness may be an area of reduced wall thickness, or an area of offset material. Preferably, if the container 10 is formed of a unitary sheet of polymeric material, as described herein, the line of weakness represents a V-shaped notch 34.

By providing a V-shaped notch 34 for the line of weakness, the sidewalls 20 may be predisposed and/or biased to articulate about the hinge lines 30 so that the sidewalls 20 collapse either inwardly or outwardly relative to the center and body of the container 10. In a preferred embodiment, as illustrated in FIGS. 3–4, opposed sidewalls 20 collapse in the same disposition. The front and rear sidewalls 20, in the illustrated embodiment, articulate so that the walls collapse outwardly and away from the container 10. In contrast, the opposed sidewalls 20 forming the left and right ends of the container 10 articulate to collapse inwardly and towards the center of the container 10. In this arrangement, oppositely disposed sidewalls 20 symmetrically articulate about a first pair of hinge lines 30 during collapse and erection. Further, each sidewall 20 collapses in an orientation opposite that of the adjacent sidewalls 20. This arrangement provides the benefit that the sidewalls 20 having the greatest dimension, i.e., that dimension parallel to the major axis, collapse outwardly so that the sidewalls 20 do not encroach on the volume of the container 10 when it is in the erect condition.

Alternatively, adjacent sidewalls 20 may collapse in the same direction, i.e., inwardly or outwardly. This arrangement provides the benefit that when all of the sidewalls 20 collapse inwardly, the container 10 has a smaller footprint in the collapsed condition. Further, such containers 10 may be more easily stacked in such a collapsed condition.

Preferably, each hinge line 30 within the sidewalls 20 is disposed the same distance from the floor pan 22 as the other hinge lines 30. This allows for the most compact collapse of the container 10. One of ordinary skill will recognize that the hinge line 30 and/or gussets 32 should be disposed such that there are generally equal amounts of material on each side of the hinge line 30. It is not necessary that each hinge line 30 be disposed the same distance from the floor pan 22 as other hinge lines 30 disposed on other sidewalls 20 of the container 10. However, it is highly desirable that the hinge lines 30 be continuous and adjacent sidewalls 20. The position of the hinge line 30 in the sidewall 20 determines the height of the container 10 in the collapsed condition. If desired, the hinge lines 30 need not be centered in the sidewalls 20 to accommodate any deviation of the sidewall 20 from the perpendicular and any radii at the juncture between the sidewall 20 and floor pan 22.

The hinge line 30 divides its respective sidewall 20 into two portions articulable about the hinge line 30. For the illustrated embodiments having a horizontal hinge line 30, the respective sidewall 20 is divided into articulable upper and lower portions. Alternatively, the hinge lines 30 may be vertically oriented so that the respective sidewalls 20 are divided into articulable left and right lateral portions. While this arrangement does not collapse to as small of a volume as that illustrated, it provides the benefit of increased rigidity in the vertical direction. Either arrangement can provide a container 10 having sidewalls 20 with sufficient rigidity to make the container 10 self-supporting.

By being self-supporting, the container 10 is capable of maintaining an erect condition against its own weight and the force of gravity. This arrangement provides the benefits that the container 10 is more convenient when loading and unloading contents. Preferably, the container 10 is transformable and compliant under forces commonly applied by hand.

Further, the sidewalls 20 are provided with gussets 32 as is known in the art. The gussets 32 further assist in the smooth, consistent and controlled collapsing and erection of the container 10. It will be apparent to one of ordinary skill that the hinge lines 30 occur at the vertex of the gussets 32, the gussets 32 being oriented generally perpendicular to the plane of the floor pan 22.

The sidewalls 20 of the container 10 are defined by and coterminous of two ends. Each end of the sidewall 20 has two pairs of diagonally opposed corners. The sidewalls 20 are shown to be rectangular, although triangular and quadrilaterally shaped sidewalls 20 are contemplated, as well as those of octagonal and other polygonal shapes.

The gussets 32 comprise fold lines 36. The fold lines 36 extend from one end of the sidewall 20 towards and intercept the hinge line 30 at the vertex 38. Preferably, each end of the sidewall 20 has a gusset 32 and fold lines 36 therein, so that both ends of the sidewall 20 uniformly collapse. Otherwise, the container 10 will collapse into a triangular configuration and assume greater storage space in the collapsed condition. The fold lines 36 of the gusset 32 do not intercept diagonally opposite corners of the sidewall 20, otherwise, articulation does not occur about the hinge line 30.

Preferably, but not necessarily, the container 10 is formed from a unitary sheet of material. By forming the container 10 from a unitary sheet of material, the presence of seal 14 lines within the body of the container 10 is eliminated and pathways for leakage are reduced. The container 10 may be blow molded, injection molded, or preferably thermoformed. The polymeric material used and the thickness of the walls and seal beads are as described above.

Figure 5:
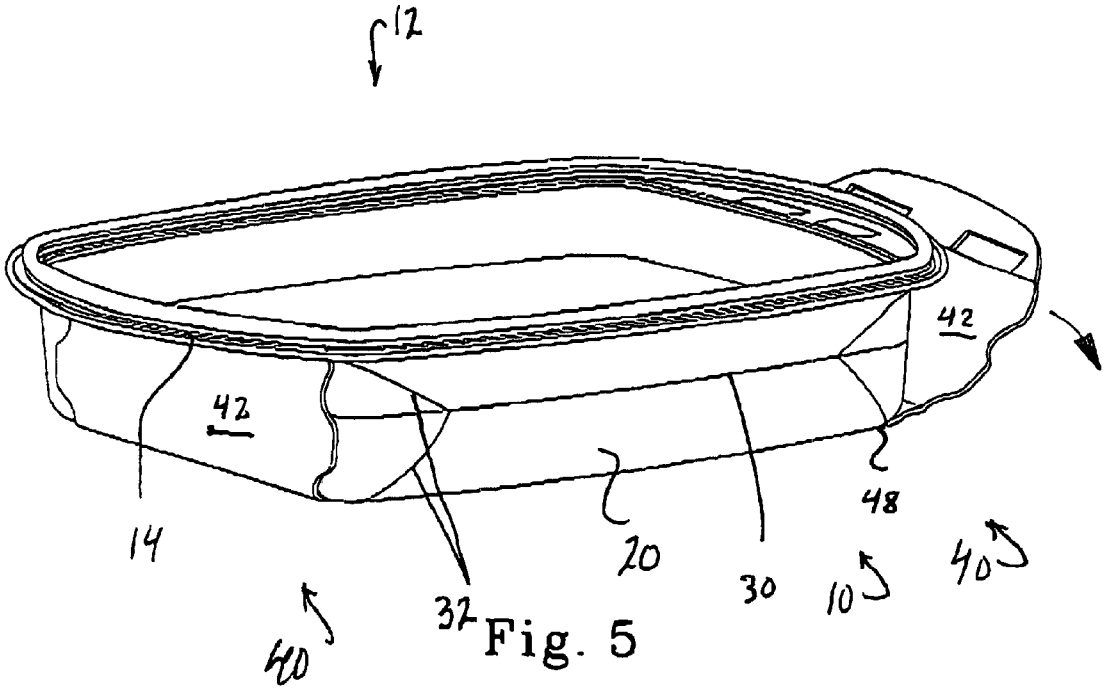
FIG. 5 is a perspective view of a container and one type of reinforcement suitable for use with the container.

Referring to FIG. 5, if desired, the container 10 may be provided with a reinforcement 40. Particularly, the reinforcement 40 may comprise struts 42 that support one or more erect sidewalls 20.

Further, the reinforcement 40 may provide a floor pan 22 support. The floor pan 22 support extends partially, and preferably completely across the length, and optionally across the width of the floor pan 22. If the floor pan 22 has an aspect ratio greater than one, preferably the floor pan 22 support extends throughout and in the direction of the major axis.

Further, the struts 42 may be articulable so that they may be applied to and removed from the sidewalls 20 as desired. Preferably, the struts 42 are articulable about a proximal end 44, the proximal end 44 being juxtaposed with the floor pan 22. The distal end 46 of the strut 42 may engage the sidewall 20, a flange circumjacent the aperture 26 of the container 10, or any other point near the top or opening of the container 10 which is convenient and provides structural support to resist collapse of the container 10 in the collapse direction. Thus, the struts 42 preferably provide reinforcement 40 in a direction generally perpendicular to the hinge line 30 in the respective sidewall 20.

If desired, the strut(s) 42 and floor pan 22 support may be comprised of a unitary and integral piece of material as illustrated. This arrangement provides a reinforcement 40 which collectively comprises one or more struts 42 and a floor pan 22 support. Collectively, opposed struts 42 and a unitary floor pan 22 support can cradle the container 10 to provide increases rigidity. This arrangement provides the benefit that the reinforcement 40 may be manufactured as a single element.

Further, attachment of the integral reinforcement 40 to the container 10 is simplified. For example, in the embodiment illustrated, the floor pan 22 support may be joined to the bottom of the floor pan 22 of the container 10. Joining of the reinforcement 40 to the container 10 may be accomplished using any suitable means such as heat sealing, ultrasonic welding, adhesive, etc.

Suitable materials for the reinforcement 40 include two-faced or single-faced corrugated, polymeric materials dissimilar, similar or identical to that used for the container 10.

A reinforcement transformable between reinforcing and nonreinforcing positions, as shown, provides the benefit that the container 10 may be transformed from a collapsed condition to an erected condition without the user inserting his or her hands into the container 10. Thus, sanitation concerns about the user's hands soiling or contaminating the inside of the container 10 when the contents of the container 10 which are desired to be kept sanitary are reduced.

Erection of such a container 10 may occur by articulating the strut 42 from the nonreinforcing position to the reinforcing position, wherein the strut 42 engages the sidewall 20 or, the flange circumjacent the aperture 26 of the container 10. By articulating the struts 42 inwardly, the rotational forces applied to the struts 42 as they are articulated toward each other become converted to extension forces that cause erection of the container 10.

What is claimed is:

1. A thermoformed erectable and collapsible container, said container being transformable from a collapsed configuration to an erected configuration and comprising a plurality of collapsible walls, wherein said collapsible walls comprise a polymeric material having:

(a) a Flexural Modulus from 100 MPa to 1750 MPa;

(b) wall thickness of the collapsible walls from 1 mil to 20 mils;

(c) wherein said collapsible walls further comprise a seal bead having a thickness of at least 1.5 times the collapsible wall thickness;

(d) wherein each of said plurality of collapsible walls are provided with a line of weakness; and, (e) wherein each of said collapsible walls is articulable about said line of weakness.

2. An erectable and collapsible container as in claim 1, wherein said collapsible walls are collapsible sidewalls, and said container further comprises an interconnected floor pan, wherein said collapsible sidewalls project from said floor pan.

3. An erectable and collapsible container as in claim 2, wherein the seal bead has a thickness from 2 to 6 times the collapsible wall thickness.

4. An erectable and collapsible container as in claim 3, wherein the seal bead has a thickness of from about 2 to about 4 times the collapsible wall thickness.

5. An erectable and collapsible container as in claim 3, wherein said collapsible wall thickness is from about 3 mils to about 6 mils.

6. An erectable and collapsible container as in claim 2, wherein said collapsible wall thickness is from 2 mils to 10 mils.

7. An erectable and collapsible container as in claim 1, wherein said container further comprises a lid that is attachable to said seal bead.

8. An erectable and collapsible container as in claim 1, wherein said Flexural Modulus is from about 175 MPa to about 1350 MPa.

9. An erectable and collapsible container as in claim 8, wherein said Flexural Modulus is from about 250 MPa to about 700 MPa.

10. An erectable and collapsible container as in claim 9, wherein said Flexural Modulus is from about 275 MPa to about 550 MPa.

11. An erectable and collapsible container as in claim 10, wherein said collapsible wall thickness is from about 2 mils to about 15 mils.

12. An erectable and collapsible container as in claim 1, wherein said polymeric material has a Izod Impact Value notched at 23 C of at least 30 J/m.

13. An erectable and collapsible container as in claim 12, wherein said polymeric material has a Izod Impact Value notched at 23 C of at least 50 J/m.

14. An erectable and collapsible container as in claim 13, wherein said polymeric material has a Izod Impact Value notched at 23 C of at least 100 J/m.

15. An erectable and collapsible container as in claim 14, wherein said polymeric material has a Izod Impact Value notched at 23 C of at least 500 J/m.

16. An erectable and collapsible container as in claim 1, wherein said polymeric material is selected from the group consisting of polyethylenes, polypropylenes, copolymers of polyethylene and polypropylene, and mixtures thereof.

17. An erectable and collapsible container as in claim 16, wherein said polymeric material comprises syndiotactic polypropylene.

18. An erectable and collapsible container as in claim 1, wherein said polymeric material comprises a mixture of polypropylene as a primary polymer and a secondary polymer selected from the group consisting of polyethylene and polyethylene/polypropylene copolymer.

19. An erectable and collapsible container as in claim 1, wherein said polymeric material is polyethylene homopolymer, said Flexural Modulus is at least 275 MPa and said wall thickness is at least 10 mils.

20. A method of making an erectable and collapsible container as claimed in claim 1 comprising:

(a) providing a bead of polymeric material having a Flexural Modulus from 100 MPa to 1750 MPa;

(b) thermoforming said bead to form a container having a plurality of collapsible walls, and said collapsible walls have a thickness of 1 mil to 20 mils.

21. A method as claimed in claim 20 wherein said polymeric material is polyethylene homopolymer, said Flexural Modulus is at least 275 MPa and said wall thickness is at least 10 mils.

22. A method of making an erectable and collapsible container as claimed in claim 1 comprising the steps of:

(a) providing a bead of polymeric material having a Flexural Modulus of 275 MPa to 1750 MPa; and, (b) thermoforming said bead to form a container having a plurality of collapsible walls.

23. A method of making an erectable and collapsible container as claimed in claim 1 comprising:

(a) providing a bead of polymeric material having a Flexural Modulus from 100 MPa to 1750 MPa;

(b) thermoforming said bead to form a container having a plurality of collapsible walls, and said collapsible walls have a thickness of 1 mil to 20 mils.

24. A method as claimed in claim 23 wherein said polymeric material is polyethylene homopolymer, said Flexural Modulus is at least 275 MPa and said wall thickness is at least 10 mils.

25. A method of making an erectable and collapsible container as claimed in claim 1 comprising the steps of:

(a) providing a bead of polymeric material having a Flexural Modulus of 275 MPa to 1750 MPa; and, (b) thermoforming said bead to form a container having a plurality of collapsible walls.

26. A thermoformed erectable and collapsible container, said container being transformable from a collapsed configuration to an erected configuration and comprising a plurality of collapsible walls, wherein each of said plurality of collapsible walls are provided with a line of weakness, wherein each of said collapsible walls is articulable about said line of weakness, wherein said collapsible walls comprise a polymeric material having a Flexural Modulus from 275 MPa to 1750 MPa and wherein said collapsible walls further comprise a seal bead having a thickness of at least 1.5 times the collapsible wall thickness.

27. An erectable and collapsible container as in claim 20, wherein said collapsible walls are collapsible sidewalls, and said container further comprises an interconnected floor pan, wherein said collapsible sidewalls project from said floor pan.

28. A method of making an erectable and collapsible container as claimed in claim 27, wherein said collapsible walls are collapsible sidewalls, and said container further comprises an interconnected floor pan, said sidewalls projecting from said floor pan have a bottom end connected to said floor pan and a top end distal from said bottom end, said container further comprising a seal bead at said top end of at least three of said sidewalls.

29. A method of making an erectable and collapsible container as claimed in claim 27, wherein said collapsible walls are collapsible sidewalls, and said container further comprises an interconnected floor pan, said sidewalls projecting from said floor pan have a bottom end connected to said floor pan and a top end distal from said bottom end, said container further comprising a seal bead at said top end of at least three of said sidewalls.

* * * * *

UNITED STATES PATENT AND TRADEMARK OFFICE

CERTIFICATE OF CORRECTION

PATENT NO. : 6,315,151 B1
DATED : November 13, 2001
INVENTOR(S) : Matthew Todd Hupp et al.

It is certified that error appears in the above-identified patent and that said Letters Patent is hereby corrected as shown below:

Column 1,
Line 45, "5,179,897" should read -- 5,379,897 --.

Column 7,
Line 31, "usefull" should read -- useful --.

Column 12,
Lines 24-31, delete Claim 23.
Lines 32-35, delete Claim 24.
Lines 36-41, delete Claim 25.
Lines 66-67, and continuing into Columns 13 and 14, delete Claim 29.

Signed and Sealed this

Eighteenth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,315,151 B1 
DATED : November 13, 2001
INVENTOR(S) : Matthew Todd Hupp et al.

It is certified that error appears in the above-identified patent and that said Letters Patent is hereby corrected as shown below:

Column 11,
Line 23, delete “of” and “about”.
Line 24, delete “about”.

Signed and Sealed this

Second Day of December, 2003

JAMES E. ROGAN
*Director of the United States Patent and Trademark Office*